US006186904B1

(12) United States Patent
Bass

(10) Patent No.: US 6,186,904 B1
(45) Date of Patent: Feb. 13, 2001

(54) GOLF SWING TRAINING CLUB

(76) Inventor: Richard S. Bass, 250 Otonabee Avenue, North York (CA), M2M 2T1

( * ) Notice: Under 35 U.S.C. 154(b), the term of this patent shall be extended for 0 days.

(21) Appl. No.: 09/277,039

(22) Filed: Mar. 25, 1999

Related U.S. Application Data

(60) Provisional application No. 60/120,336, filed on Feb. 17, 1999.

(51) Int. Cl.[7] ..... A63B 69/36

(52) U.S. Cl. ..... 473/256; 473/219; 473/296; 482/109

(58) Field of Search ..... 473/219, 171, 473/300, 297, 337, 256, 296; D21/733, 734, 753; 241/169.2; 482/109

(56) References Cited

U.S. PATENT DOCUMENTS

| | | | | |
|---|---|---|---|---|
| 405,128 | * | 6/1889 | Stockburger | 482/106 |
| 1,696,462 | * | 12/1928 | Victor | 473/297 |
| 2,628,099 | * | 2/1953 | Murphy | 473/290 |
| 3,351,346 | * | 11/1967 | Strahan | 473/256 |
| 3,502,329 | * | 3/1970 | Brazier | 482/107 |
| 3,637,218 | * | 1/1972 | Carlino | 473/325 |
| 3,743,297 | * | 7/1973 | Dennis | 473/242 |
| 3,759,527 | * | 9/1973 | Witherspoon | 473/219 |
| 4,602,786 | * | 7/1986 | Wendt | 473/242 |
| 5,024,438 | * | 6/1991 | Candow | 473/294 |
| 5,083,790 | * | 1/1992 | Wheatley | 473/256 |
| 5,121,925 | * | 6/1992 | Blundo | 473/242 |
| 5,174,567 | * | 12/1992 | Nordstrom | 473/446 |
| 5,306,010 | * | 4/1994 | Choi | 473/239 |
| 5,330,190 | * | 7/1994 | Oakley, Jr. | 473/234 |
| 5,465,967 | * | 11/1995 | Boeckenhaupt | 473/297 |
| 5,653,645 | * | 8/1997 | Baumann | 473/305 |
| 5,807,183 | * | 9/1998 | Benson | 473/206 |
| 5,865,686 | * | 2/1999 | MacGregor | 473/228 |
| 5,976,031 | * | 11/1999 | Johnson | 473/300 |

* cited by examiner

*Primary Examiner*—Stephen F. Gerrity
*Assistant Examiner*—Rhonda E Sands
(74) *Attorney, Agent, or Firm*—Dennis L. Cook

(57) ABSTRACT

A weighted sport training assembly used to overload the muscles while making sport specific movements during sport training. The principle can be applied to several sports implements such as a golfclub, a tennis or squash racquet, hockey stick, baseball bat, and other similar sports devices. The Golf Swing Training Club is an assembly of golfclub pieces and weights combined to offer an individual training a golf swing, or performing exercises that are either technical in nature, or fitness related, the opportunity to change the shape, length, or weight of the club by adding an extension shaft and inserting a variety of weights into the assembly.

5 Claims, 3 Drawing Sheets

GOLF SWING TRAINING CLUB

CROSS-REFERENCE TO RELATED APPLICATION

The present application claims the benefit of previously filed co-pending Provisional Pat. Application, Ser. No. 60/120,336 filed Feb. 17, 1999.

FIELD OF THE INVENTION

The present invention is an improvement in weighted training devices and, more specifically, is a set of golfclub pieces combined to offer an individual training a golf swing, or performing exercises that are either technical in nature, or fitness related, the opportunity to change the shape, length, or weight of the device.

BACKGROUND OF THE INVENTION

There are many golf swing training devices in the marketplace that claim significant results when used correctly and regularly. While most of them have some merit and offer some benefits, they all can be generally categorized by their limitations.

One category includes training devices that are unweighted in comparison to actual clubs. Since these training devices are not weighted, they do not overload the muscles of the golfer sufficiently to develop the strength and conditioning needed to produce a correct golf swing.

Another category includes training devices that are weighted which use a variety of straight or bent shafts. Most of these however do not have the look or feel of an actual golfclub. They are also not adjustable and do not allow for differences and changes in levels of strength and conditioning which can result in improper training.

A third category does not involve a golfclub substitute at all, but employs swing guidance devices such as hoops, tracks, belts and the like. These devices are designed to force the golfer to swing an actual golfclub or training device on a proper swing path. Such devices are generally quite complicated. They are not portable and require time setting up for each individual golfer.

It is therefore an object of this invention to provide a sport swing training device which is weighted such that proper muscle memory develops. It is a further object of this invention to provide a golf swing training device which is both an indoor and outdoor training device in which the user has the ability to change the length and weight of the club. It is a further object of this invention to allow the user to attach a standard golfclub head to the end of the club to simulate the look and feel of an actual golfclub. The club fits in standard golf bags so it can be also used as a warm-up club on an actual course.

SUMMARY OF THE INVENTION

The present invention is a weighted sport training device to overload the muscles while making sport specific movements during sport training. The principle can be applied to several sports implements such as a golfclub, a tennis or squash racquet, hockey stick, baseball bat, and other similar sports devices. The Golf Swing Training Club is a set of golfclub pieces and weights combined to offer an individual training a golf swing, or performing exercises that are either technical in nature, or fitness related, the opportunity to change the shape, length or weight of the device.

BRIEF DESCRIPTION OF THE DRAWINGS

Other objects, features, and advantages of the present invention will become apparent from the detailed description of the invention, which follows, when considered in light of the accompany drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The Golf Swing Training Club is a set of golfclub pieces combined to offer an individual training a golf swing, or performing exercises that are either technical in nature, or fitness related, the opportunity to change the length or weight of the device.

The distinguishing features are that the club is designed as both an indoor and outdoor training device consisting of waterproof materials which allows the user to carry the club with him in a regular size golf bag for use as a warm-up club. Also, the user has the ability to change the length of the club from approximately 17 inches to a length of greater than 34 inches. The club allows for incremental increases in weight from approximately 15 ounces to several pounds in approximately 3-ounce progressive increments. The club can also have a golfclub head attached at the end to simulate the look and feel of an actual golfclub.

Figure 1:
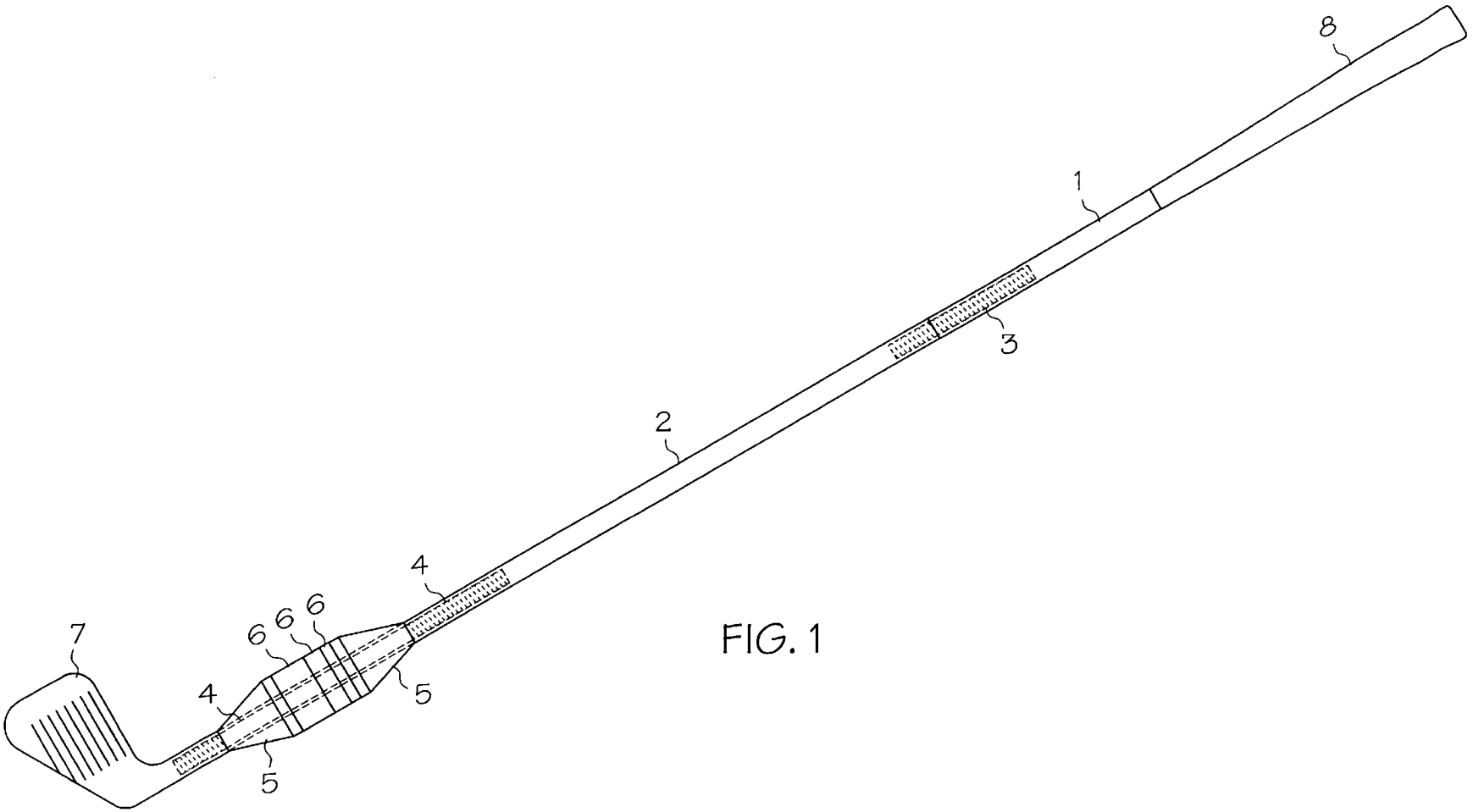
FIG. 1 is a diagram showing the assembled Golf Swing Training Club.
Figure 2:
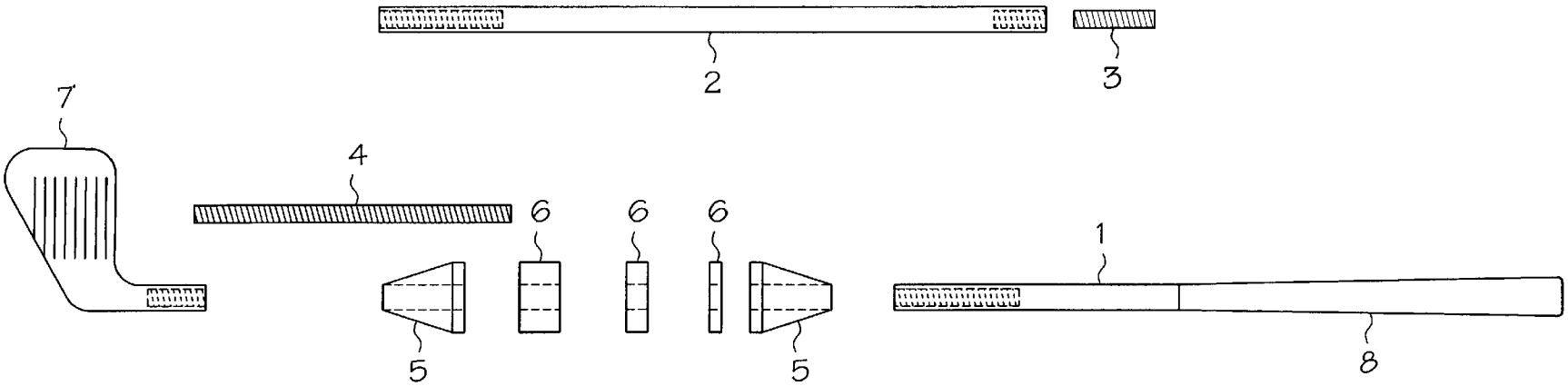
FIG. 2 is a blown-up diagram of the Golf Swing Training Club.
Figure 3:
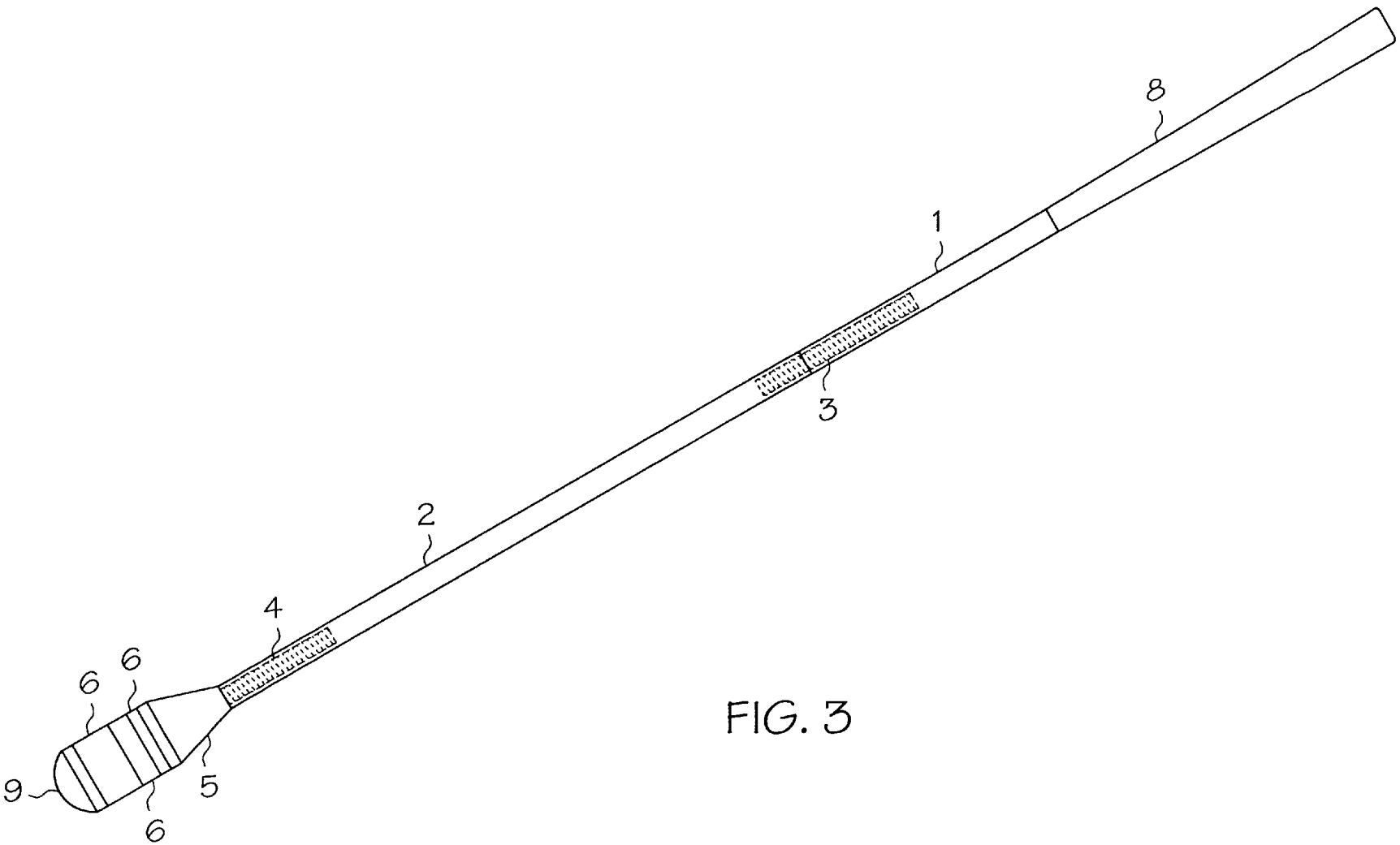
FIG. 3 is a diagram showing the assembled Golf Swing Training Club with an end cap rather than the golfclub head installed.

Referring now to FIG. 2, one can easily observe the construction of the preferred embodiment that consists of a main aluminum shaft (1) 17 inches long and 0.6250 inches in diameter. This shaft has a standard golfclub grip (8) at one end and 7/16 inch, type 20, female thread, at least 3 inches deep at the other end. An additional 17-inch aluminum shaft extension piece (2), which has 7/16 inch, type 20, female thread, at least 3 inches deep on one end, and 0.875 inches deep on the other end, can be connected to the main aluminum shaft (1) by a 2.0 inch stainless steel, 7/16 inch, type 20, threaded rod (3), to create the extended version of the training club. Screwed into the end of the main aluminum shaft (1), or extended aluminum shaft (2) when it is attached to the main aluminum shaft (1) to make the extended version, opposite the grip (8), is a 7 ¾ inch stainless steel, 7/16 inch, type 20, threaded rod (4). An aluminum or brass cone shaped molding (5), 2 inches long, and 1.75 inches in diameter at the widest end and 0.625 inches in diameter at the narrowest end, with an unthreaded cylindrical opening slightly larger than the diameter of the 7/16 inch, type 20 threaded rod extending completely through its longitudinal center, is then slid onto the threaded rod (4) with the narrowest end of the cone shaped molding (5) abutting the main aluminum shaft (1), or the extended aluminum shaft (2) in the extended version. Next, any combination of a series of three varying weight and width (0.25 inches [approx. 3 oz], 0.50 inches [approx. 6 oz], 1.0 inches [approx. 12 oz]), cylindrically shaped, 1.75 inches in diameter, brass washers (6), all of which have unthreaded cylindrical openings slightly larger than the diameter of the 7/16 inch, type 20 threaded rod extending completely through their centers, are slid over the threaded rod (4) and abut against the widest end of the cone-shaped molding (5). After the series of brass washers (6), a second aluminum or brass cone shaped molding (5), with the same dimensions as the first cone shaped molding (5), is slid on facing opposite the first cone-shaped molding (5) and abuts against the last brass washer (6). A standard golfclub head (7), having a female threaded hosel, is then screwed onto the threaded rod (4) and secured with a glue, such as Locktight, to hold the assembly together. Alternatively, referring to FIG. 3, an aluminum end cap (9) with a female threaded bolt-hole can be screwed onto the threaded rod (4), instead of the second cone shaped molding (5) and golfclub head (7), and secured with a glue, such as Locktight, to hold the assembly together. When changes to the club's weight or length are desired by the user he or she merely grips and turns the golfclub head (7) or aluminum end cap (9) and unscrews the assembly from the main aluminum shaft (1), or extended aluminum shaft (2) and makes the desired changes.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims.

That which is claimed:

1. A portable sport swing training assembly comprising:

a shaft said shaft having a standard sport club grip at one end said shaft having female threads at the opposite end a threaded rod, said threaded rod being screwed part way into said shaft's female threaded end, one or more weights, each of said weights having a cylindrical opening slightly larger than the diameter of said threaded rod, but not as large as the diameter of said shaft, extending through the longitudinal center of said weights, any combination of one or more said weights being slid over said threaded rod extending from said shaft such that said combination of one or more said weights abuts against said shaft, an end cap, said end cap having a female threaded connection means, said threaded rod extending from said shaft being screwed into said end cap=s female threaded connection means such that said end cap abuts said combination of one ore more said weights, an extension shaft, said extension shaft having female threads on both ends, a second threaded rod, said second threaded rod being screwed part way into one end of said extension shaft, said threaded rod being screwed part way into the other end of said extension shaft; and, said extension shaft being connected to said shaft by said second threaded rod extending from said extension shaft being screwed into said shaft's female threaded end.

2. A portable golf swing training assembly comprising:

a shaft, said shaft having a standard golf grip at one end, said shaft having female threads at the opposite end, a threaded rod, said threaded rod being screwed part way into said shaft's female threaded end, one or more weights, each of said weights having a cylindrical opening slightly larger than the diameter of said threaded rod, but not as large as the diameter of said shaft extending through the longitudinal center of said weights, any combination of one or more said weights being slid over said threaded rod extending from said shaft such that said combination of one or more said weights abuts against said shaft, an end cap, said end cap having a female threaded connection means, said threaded rod extending from said shaft being screwed into said end cap's female threaded connection means such that said end cap abuts said combination of one or more said weights, an extension shaft, said extension shaft having female threads on both ends, a second threaded rod, said second threaded rod being screwed part way into one end of said extension shaft, said threaded rod being screwed part way into the other end of said extension shaft; and, said extension shaft being connected to said shaft by said second threaded rod extending from said extension shaft being screwed into said shaft's female threaded end.

3. A portable golf swing training assembly comprising;

a shaft, said shaft having a standard golf grip at one end, said shaft having female threads at the opposite end, a threaded rod, said threaded rod being screwed part way into said shaft's female threaded end, one or more weights, each of said weights having a cylindrical opening slightly larger than the diameter of said threaded rod, but not as large as the diameter of said shaft, extending through the longitudinal center of said weights, any combination of one or more said weights being slid over said threaded rod extending from said shaft such that said combination of one or more said weight abuts against said shaft, a golfclub head, said golfclub head having a female threaded hosel, said threaded rod extending from said shaft being screwed into said golfclub head's female threaded hosel such that said golfclub head's hosel abuts said combination of one or more said weights, an extension shaft, said extension shaft having female threads on both ends, a second threaded rod, said second threaded rod being screwed part way into one end of said extension shaft, said threaded rod being screwed part way into the other end of said extension shaft; and said extension shaft being connected to said shaft by said second threaded rod extending from said extension shaft being screwed into said shaft's female threaded end.

4. A portable golf swing training assembly comprising;

a shaft, said shaft having a standard golf grip at one end, said shaft having female threads at the opposite end, a threaded rod, said threaded rod being screwed part way into said shaft's female threaded end.

a cone shaped molding, said cone shaped molding having a cylindrical opening slightly larger than the diameter of said threaded rod, but not as large as the diameter of said shaft, extending through said cone shaped molding's longitudinal center, said cone shaped molding being slid over said threaded rod extending from said shaft such that said cone shaped molding's smaller end abuts said shaft, one or more cylindrically shaped weights having varying thicknesses such that said cylindrically shaped weights have varying weights, each of said cylindrically shaped weights having a cylindrical opening slightly larger than the diameter of said threaded rod, but not as large as the diameter of said shaft, extending through the longitudinal center of said cylindrically shaped weights, any combination of one or more said cylindrically shaped weights being slid over said threaded rod extending from said shaft such that said combination of one or more cylindrically shaped weights abuts against said cone shaped molding's larger end, an end cap, said end cap having a female threaded connection means, said threaded rod extending from said shaft being screwed into said end cap's female threaded connection means such that said end cap abuts said combination of one or more cylindrically shaped weights, an extension shaft, said extension shaft having female threads on both ends, a second threaded rod, said second threaded rod being screwed part way into one end of said extension shaft, said threaded rod being screwed part way into the other end of said extension shaft; and, said extension shaft being connected to said shaft by said second threaded rod extending from said extension shaft being screwed into said shaft's female threaded end.

5. A portable golf swing training assembly comprising;

a shaft, said shaft having a standard golf grip at one end, said shaft having female threads at the opposite end, a threaded rod, said threaded rod being screwed part way into said shaft's female threaded end, a cone shaped molding, said cone shaped molding having a cylindrical opening slightly larger than the diameter of said threaded rod, but not as large as the diameter of said shaft, extending through said cone shaped molding's longitudinal center, said cone shaped molding being slid over said threaded rod extending from said shaft such that said cone shaped molding's smaller end abuts said shaft, one or more cylindrically shaped weights having varying thicknesses such that said cylindrically shaped weights have varying weights, each of said cylindrically shaped weights having a cylindrical opening slightly larger than the diameter of said threaded rod, but not as large as the diameter of said shaft, extending through the longitudinal center of said cylindrically shaped weights, any combination of one or more said cylindrically shaped weights being slid over said threaded rod extending from said shaft such that said combination of one or more cylindrically shaped weights abuts against said cone shaped molding's larger end, a second cone shaped molding, said second cone shaped molding having a cylindrical opening slightly larger than the diameter of said threaded rod, but not as large as the diameter of said shaft, extending through said cone shaped molding's longitudinal center, said second cone shaped molding being slid over said threaded rod extending from said shaft such that said second cone shaped molding's larger end abuts said combination of one or more cylindrically shaped weights, a golfclub head, said golfclub head having a female threaded hosel, said threaded rod extending from said shaft being screwed into said golfclub head's female threaded hosel such that said golfclub head's hosel abuts said second cone shaped molding's smaller end, an extension shaft, said extension shaft having female threads on both ends, a second threaded rod, said second threaded rod being screwed part way into one end of said extension shaft, said threaded rod being screwed part way into the other end of said extension shaft; and said extension shaft being connected to said shaft by said second threaded rod extending from said extension shaft being screwed into said shaft's female threaded end.

* * * * *